United States Patent [19]

Shiozawa

[11] Patent Number: 4,929,204

[45] Date of Patent: May 29, 1990

[54] WATER ENTRY PREVENTING STRUCTURE FOR INBOARD/OUTBOARD MOTOR

[75] Inventor: Shigeki Shiozawa, Hamamatsu, Japan

[73] Assignee: Sanshin Kogyo Kabushiki Kaisha, Nippashi, Japan

[21] Appl. No.: 262,723

[22] Filed: Aug. 19, 1988

[30] Foreign Application Priority Data

Aug. 20, 1987 [JP] Japan ..... 62-206647

[51] Int. Cl.[5] ..... B63H 21/30

[52] U.S. Cl. ..... 440/112

[58] Field of Search ..... 440/52, 57, 61, 75, 440/88, 89, 111, 112

[56] References Cited

U.S. PATENT DOCUMENTS 3,136,281 6/1964 Kiekhaefer et al. ..... 440/52

3,376,842 4/1968 Wynne ..... 440/57

4,634,391 1/1987 Entringer et al. ..... 440/52

*Primary Examiner*—Joseph F. Peters, Jr.

*Assistant Examiner*—Jesus D. Sotelo

*Attorney, Agent, or Firm*—Ernest A. Beutler

[57] ABSTRACT

A number of embodiments of marine inboard/outboard drives including an arrangement for sealing the flywheel housing so as to prevent the intrusion of water into it. In all embodiments, a flexible coupling connects the engine flywheel to an input shaft of the outboard drive and this flexible coupling is positioned within the flywheel housing. Various sealing arrangements are incorporated for sealing the opening in the flywheel housing through which the input shaft of the outboard drive extends.

17 Claims, 3 Drawing Sheets

WATER ENTRY PREVENTING STRUCTURE FOR INBOARD/OUTBOARD MOTOR

BACKGROUND OF THE INVENTION

This invention relates to a water entry preventing structure for an inboard/outboard motor and more particularly to an improved arrangement for preventing the entry of water into the flywheel housing of an inboard/outboard drive.

One widely used form of marine propulsion system is the "inboard/outboard" drive in which an internal combustion engine is mounted within the hull of the watercraft and the watercraft is propelled by a propulsion unit that is mounted outside of the hull and driven by the engine by means including an input shaft that extends through the transom of the hull. In accordance with such arrangements, it is the normal practice to provide some form of elastic coupling between the output shaft of the engine and the input shaft of the outboard drive propulsion unit so as to accommodate for angular misalignments and so as to permit movement of the engine to absorb vibrations by its resilient support. These flexible couplings are normally positioned in proximity to adjacent the flywheel of the engine so as to provide damping at the desired location.

Although this type of arrangement is particularly satisfactory, it is the normal practice to provide a flywheel housing that encircles the flywheel but which has a relatively large opening that is positioned in proximity to the flexible coupling and normally encircles it. Because of the large diameter of the opening in the flywheel cover, there is the likelihood that water may enter into the flywheel cover. The large diameter of the opening places its lower peripheral edge quite low in the watercraft and hence it is prone to the likelihood of bilge water entering it. In addition, the large clearance normally provided around the flexible coupling and its large diameter also aggravates the problem of water entry.

When water enters the flywheel housing, it can become engaged with the teeth of the starter gear mechanism and will be thrown by the rotation of the flywheel into proximity with the starter of the engine. The water can readily cause corrosion of the starter which can render its operation either difficult or, in extreme instances, inoperative.

It is, therefore, a principal object of this invention to provide an improved driving arrangement for an inboard/outboard drive that will preclude the entry of water into the flywheel housing.

It is a further object of this invention to provide an improved arrangement for reducing the likelihood of water entry into the flywheel housing of a marine propulsion unit.

It is yet another object of this invention to provide a drive arrangement for an inboard/outboard drive wherein the flexible coupling for the drive is positioned and sealed in such a way relative to the flywheel housing so as to insure against the entry of water into the flywheel housing.

SUMMARY OF THE INVENTION

A first feature of this invention is adapted to be embodied in a marine inboard/outboard drive that comprises an engine that is adapted to be positioned within a hull and which drives a propulsion unit positioned externally of the hull and which propulsion unit includes an input shaft that extends through the hull into proximity to the engine. The engine has an output shaft and a flexible coupling, is driven by the output shaft and has a splined connection with the input shaft. In accordance with this feature of the invention, a housing is affixed to the engine and completely encloses the flexible coupling.

Another feature of this invention is adapted to be embodied in a marine inboard/outboard drive that is comprised of an engine that is adapted to be positioned within a hull, a propulsion unit that is positioned externally of the hull and drive means including shaft means for driving the propulsion unit from an engine output shaft. In accordance with this feature of the invention, a flywheel is affixed to the engine output shaft and is enclosed within a flywheel housing that has an opening through which a portion of the shaft means extends. Sealing means are provided for sealing this portion of the shaft means relative to the flywheel housing opening.

PREFERRED EMBODIMENTS OF THE INVENTION

Figure 1:
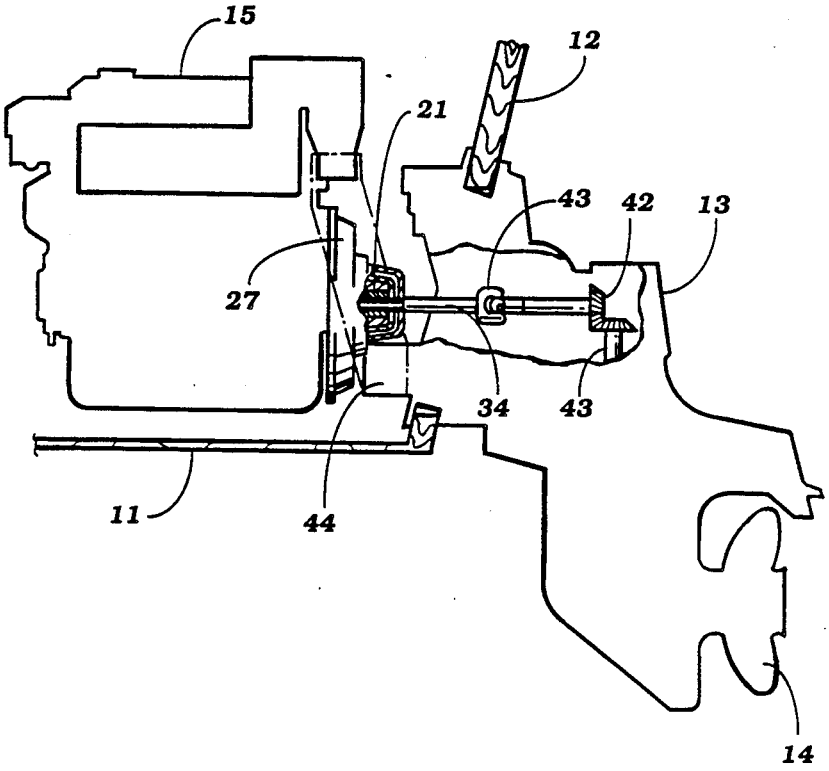
FIG. 1 is a side elevational view of a marine outboard drive and a portion of the hull of the associated watercraft, with portions broken away and other portions shown in section.

Referring now in detail to the drawings and primarily to FIG. 1, a watercraft hull is shown partially in cross section and is identified generally by the reference numeral 11. The hull 11 includes a transom 12 from which is suspended an outboard drive unit 13. As is well known in this art, the outboard drive unit 13 is supported on the transom 12 in such a manner as to permit a propeller 14, which is driven by a drive arrangement, to be described, to be steered about a generally vertically extending axis and to be tilted about a generally horizontally extending axis. Since this portion of the construction forms no part of the invention, it has not been described in detail.

An internal combustion engine 15, which may be of any known type, is supported within the hull 11 on a suitable supporting system. This supporting system may include elastic supports for vibration damping of the vibrations which are generated by the normal operation of the engine 15. Since this mounting arrangement forms no part of the invention, it has not been illustrated and any of the known systems may be used for this purpose.

Figures 2, 3:
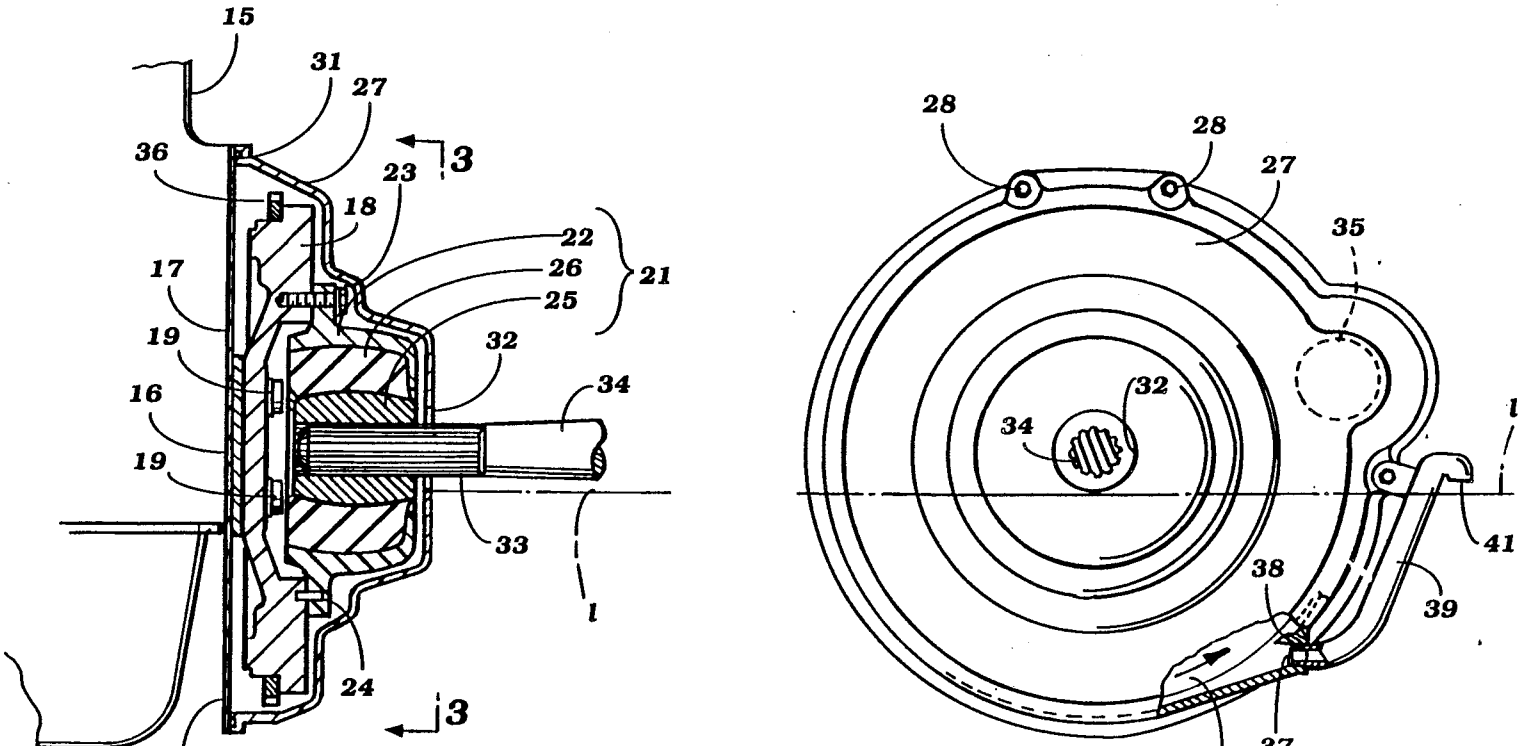
FIG. 2 is an enlarged cross sectional view showing the driving connection between the engine output shaft and the outboard drive input shaft, the flywheel, flywheel housing and associated components.
FIG. 3 is a cross sectional view taken along the line 3-3 of FIG. 2.

Referring now additionally to FIGS. 2 and 3, the engine, which is depicted as being of the reciprocating type, has an output or crankshaft 16 that extends through a rear face of the cylinder block 17 of the engine and to which is coupled a flywheel 18 by means including bolts 19. The flywheel 18 has affixed to it a flexible coupling, indicated generally by the reference numeral 21 which is comprised of an outer rigid member 22 that is connected to the flywheel 18 by means of bolts 23 and locating pins 24. An inner sleeve 25 of the coupling 21 is connected to the outer member 22 by an elastomeric sleeve 26 so as to permit some movement between the inner sleeve 25 and outer member 22 so as to compensate for angular and axial misalignments such as occur during normal installation and also during engine operation due to the resilient mounting of the engine and other factors.

In accordance with the invention, the flywheel 18 and the complete resilient coupling 21 are contained within a flywheel housing 27 that is affixed to the engine cylinder block 15 by threaded fasteners 28. The forward end of the flywheel housing 27 is closed by means of a cover plate 29 and an angular gasket 31 is positioned between the flywheel housing 27 and cover plate 29 so as to provide a watertight assembly.

The central portion of the flywheel housing 19 is provided with a relatively small diameter opening 32 through which a splined end 33 of an input shaft 34 of the outboard drive unit 13 extends. The flexible coupling inner sleeve 25 has a splined interior opening that receives the splines 33 of the input shaft 34 so as to provide a driving connection between the engine output shaft 16 and the input shaft 34. Because the opening 32 is positioned closely adjacent the coupling 21 it can be relatively small and still accommodate for the aforenoted misalignments which may occur during installation and running of the engine. Also, the close proximity of the rear face of the flywheel housing 27 and specifically the opening 32 to the inner member 25 of the flexible coupling 21 affords a very small opening through which very little if any water may pass.

It should be noted that the engine 15 is provided with an electric starter, indicated partially in phantom at 35 and which has a starter gear assembly that cooperates with a ring gear 36 that is affixed to the flywheel 18.

Water may accumulate in the hull 11 to a rather substantial height indicated by the line 1 (FIG. 2) before it can enter into the opening 32. This is particularly important since the hull may pitch and lean during normal watercraft operation and even relatively small amounts of water can reach fairly substantial depths during these movements of the hull. Unlike previously proposed constructions, however, the hole 32 can be made very small and accordingly the system can tolerate a high water level without water entering into the flywheel housing 27. In addition, the close proximity of the sleeve 25 to the opening 32 also acts like a seal so as to substantially restrict the likelihood of any water entering into the system.

If any water does enter, it can be discharged through a system best shown in FIG. 3. As shown in FIG. 3, the flywheel housing 27 is formed with a water discharge opening 37 that is disposed slightly above the lower end of the flywheel housing 27 and in the direction of rotation of the flywheel 18. A protruding lip 38 overlies the discharge opening 37 so that any water which may enter the flywheel housing 27 will be thrown upwardly deflected by the lip 38 and enter the discharge opening 37. A conduit 39 extends from the discharge opening 37 to a discharge point 41 above the highest level of anticipated water in the hull so as to insure that this water will be discharged from the flywheel housing.

As may be seen in FIG. 1, the outboard drive portion input shaft 34 drives the propeller 14 through a drive train that includes a bevel gear mechanism 42 and universal joint 43. The bevel gear mechanism 42, in turn, drives a vertically extending drive shaft 43 which is coupled to a propeller shaft (not shown) through a forward, neutral, reverse transmission.

Cooling water from the engine 15 and exhaust gases are also discharged through the outboard drive unit 13 by means of a discharge system including a conduit 44. This coolant and exhaust gas discharge may be of any known type.

Figure 4:
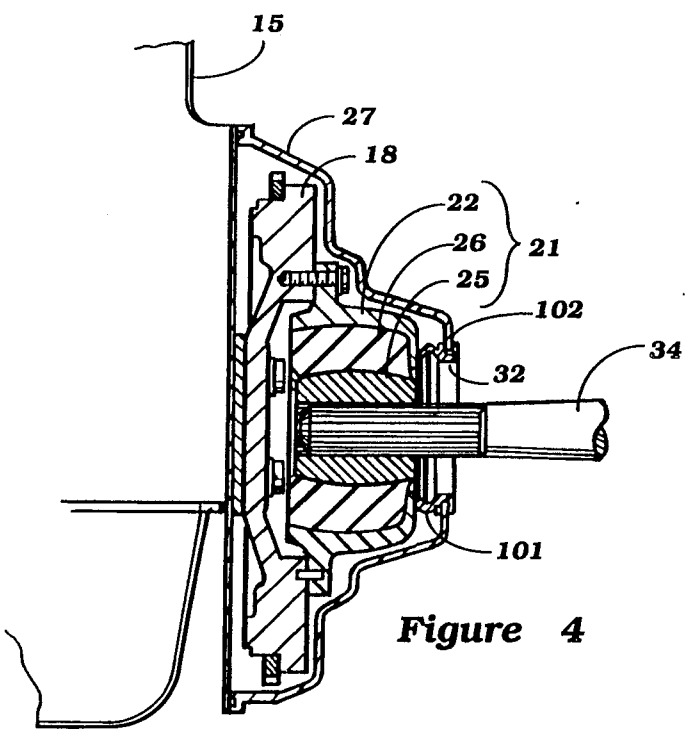
FIG. 4 is a cross sectional view, in part similar to FIG. 2, showing another embodiment of the invention.

FIG. 4 shows another embodiment of the invention which is generally similar to the embodiment of FIGS. 1 through 3 and where components of this embodiment are the same as the previously described embodiment, they have been identified by the same reference numerals and will not be described again except insofar as is necessary to understand the construction and operation of this embodiment.

In this embodiment, the opening 32 may be made slightly larger in that there is provided a bellows type seal 101 that has a groove lip portion 102 that affixes it to the flywheel housing 27 around the opening 32 and which is yieldably biased by its own rigidity into sealing engagement with the flexible coupling outer housing member 22. As a result, there is provided a fluid-tight seal between the opening 32 and the drive mechanism.

Figure 5:
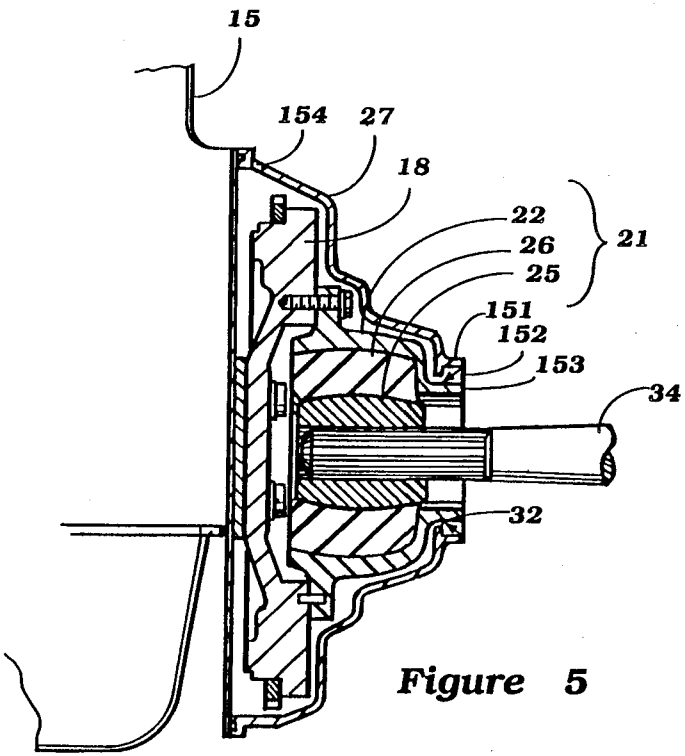
FIG. 5 is a cross sectional view, in part similar to FIGS. 2 and 4, showing a still further embodiment of the invention.

FIG. 5 shows another embodiment of the invention which is generally similar to the embodiment of FIG. 4 and those components of this embodiment which are the same as the embodiment of FIG. 4 have been identified by the same reference numerals. In this embodiment, the opening 32 in the flywheel housing 27 is defined by an extending portion 151 that has a recess which receives a lip type seal 152 that is in sealing engagement with an extending flange 153 of the flexible coupling outer member 22 so as to provide sealing. A vent opening 154 is provided in the flywheel housing 27 at an upper location therein so as to permit moisture to escape from the interior of the flywheel housing 27.

It should be readily apparent from the foregoing description that a number of embodiments of the invention have been illustrated and described and each of which provides for effective sealing of the flywheel housing of the engine of an inboard/outboard drive through the use of a relatively small opening in the flywheel housing through which the input shaft of the outboard drive unit passes so as to completely contain the flexible coupling of the drive mechanism. In addition, a variety of sealing arrangements have been disclosed for sealing this opening and for permitting any moisture which does enter the housing to escape. Various changes and modifications may be made from the preferred embodiments of the invention as described without departing from the spirit and scope of the invention, as defined by the appended claims.

I claim:

1. In a marine inboard/outboard drive comprising an engine adapted to be positioned within a hull and driving a propulsion device positioned externally of the hull and in which said propulsion device includes an input shaft that extends through the hull into proximity to said engine, said engine having an output shaft, and an elastic flexible coupling driven by said output shaft, said input shaft having a splined connection to said flexible coupling for driving said input shaft from said engine output shaft, said elastic flexible coupling having sufficient resilience to accommodate angular misalignment between said engine output shaft and said input shaft, the improvement comprising a housing affixed to said engine and completely enclosing said flexible coupling, said housing having an enlarged opening through which the input shaft passes, said enlarged opening being sufficiently larger than said input shaft to accommodate angular misalignment, and means for precluding leakage through said housing opening.

2. In a marine inboard/outboard drive as set forth in claim 1 wherein the means for precluding leakage comprises seal means.

3. In a marine inboard/outboard drive as set forth in claim 2 wherein the seal means is operative between the housing and the coupling.

4. In a marine inboard/outboard drive as set forth in claim 3 wherein the seal means is carried by the housing.

5. In a marine inboard/outboard drive as set forth in claim 1 wherein there is a flywheel affixed to the engine output shaft and contained within the housing.

6. In a marine inboard/outboard drive comprising an engine adapted to be positioned within a hull and driving a propulsion device positioned externally of the hull and in which said propulsion device includes an input shaft that extends through the hull into proximity to said engine, said engine having an output shaft, and a flexible coupling driven by said output shaft, said input shaft having a splined connection to said flexible coupling for driving said input shaft from said engine output shaft, the improvement comprising a housing affixed to said engine and completely enclosing said flexible coupling, said housing having an opening through which the input shaft passes and means for precluding leakage through said housing opening comprising said flexible coupling being positioned in close proximity to said opening for blocking the flow of fluid through said opening.

7. In a marine inboard/outboard drive as set forth in claim 6 wherein the flexible coupling is larger than the opening and obstructs the opening.

8. In a marine inboard/outboard drive as set forth in claim 6 wherein the cover encloses a flywheel driven by the engine output shaft and drivingly connected to the flexible coupling, said housing comprising a first generally cup shaped member that is affixed to and in sealing relationship with a rear wall of the engine.

9. In a marine inboard/outboard drive as set forth in claim 8 wherein the flexible coupling is larger than the opening and obstructs the opening.

10. In a marine inboard/outboard drive as set forth in claim 8 wherein the means for precluding leakage further comprises seal means.

11. In a marine inboard/outboard drive as set forth in claim 10 wherein the seal means is operative between the housing and the coupling.

12. In a marine inboard/outboard drive as set forth in claim 11 wherein the seal means is carried by the housing.

13. In a marine inboard/outboard drive as set forth in claim 12 wherein the seal means comprises a bellows type seal having a grooved portion for affixing said seal means in the housing opening and an extending portion sealingly engaged with the flexible coupling.

14. In a marine inboard/outboard drive as set forth in claim 12 wherein the seal means is supported within a recess formed in the housing around the opening and has lip means sealingly engaged with an extension of the flexible coupling.

15. In a marine inboard/outboard drive comprising an engine adapted to be positioned within a hull and driving a propulsion device positioned externally of the hull and in which said propulsion device includes an input shaft that extends through the hull into proximity to said engine, said engine having an output shaft, and a flexible coupling driven by said output shaft, said input shaft having a splined connection to said flexible coupling for driving said input shaft from said engine output shaft, the improvement comprising a housing affixed to said engine and completely enclosing said flexible coupling, said housing having an opening through which the input shaft passes and means for precluding leakage through said housing opening comprising seal means carried by said housing and operative between the housing and said coupling, said seal means comprising a bellows type seal having a grooved portion for affixing said seal means in said housing opening and an extending portion sealingly engaged with said flexible coupling.

16. In a marine inboard/outboard drive comprising an engine adapted to be positioned within a hull and driving a propulsion device positioned externally of the hull and in which said propulsion device includes an input shaft that extends through the hull into proximity to said engine, said engine having an output shaft, and a flexible coupling driven by said output shaft, said input shaft having a splined connection to said flexible coupling for driving said input shaft from said engine output shaft, the improvement comprising a housing affixed to said engine and completely enclosing said flexible coupling, said housing having an opening through which the input shaft passes and means for precluding leakage through said housing opening comprising seal means carried by said housing and operative between the housing and said coupling, said seal means being supported within a recess formed in said housing around the opening and having lip means sealingly engaged with an extension of the flexible coupling.

17. In a marine inboard/outboard drive comprising an engine adapted to be positioned within a hull and driving a propulsion device positioned externally of the hull and in which said propulsion device includes an input shaft that extends through the hull into proximity to said engine, said engine having an output shaft, and a flexible coupling driven by said output shaft, said input shaft having a splined connection to said flexible coupling for driving said input shaft from said engine output shaft, the improvement comprising a housing affixed to said engine and completely enclosing said flexible coupling, a flywheel affixed to said engine output shaft within said housing, said flywheel having affixed to it a ring gear, and a water discharge opening formed in said housing above the lower end thereof and in the direction of rotation of said flywheel for receiving water which may escape into said housing and thrown up by said ring gear.

* * * * *